United States Patent [19]

Michaelis

[11] 4,237,806

[45] Dec. 9, 1980

[54] INSTALLATION OF SEPARABLE SLIDE FASTENER ON ARTICLE

[75] Inventor: Walter J. Michaelis, Meadville, Pa.

[73] Assignee: Textron Inc., Providence, R.I.

[21] Appl. No.: 46,294

[22] Filed: Jun. 7, 1979

[51] Int. Cl.[3] ..... D05B 3/12; D05B 3/14; D05B 3/16; D05B 3/18

[52] U.S. Cl. ..... 112/265.2

[58] Field of Search ..... 112/265.2, 104, 121.27, 112/162, 177, 106

[56] References Cited

U.S. PATENT DOCUMENTS

| | | | |
|---|---|---|---|
| 2,697,227 | 12/1954 | Prupis et al. | 112/265.2 |
| 2,969,029 | 1/1961 | Morin | 112/265.2 |
| 3,158,118 | 11/1964 | Steingruebner | 112/265.2 |
| 3,246,620 | 4/1966 | Sigoda et al. | 112/162 |
| 3,286,669 | 11/1966 | Rockerath | 112/265.2 |
| 3,968,523 | 7/1976 | Newman | 112/265.2 X |
| 4,169,421 | 10/1972 | Foults | 112/265.2 X |

*Primary Examiner*—Ronald Feldbaum
*Attorney, Agent, or Firm*—O'Brien & Marks

[57] ABSTRACT

Separating slide fastener tapes are installed on opposite article portions by first sewing one of the article portions to one half of a single slide fastener stringer tape section, and then sewing the other article portion to the other half of the single slide fastener tape section which has a retainer at one end and a pin member at the other end. The single slide fastener stringer tape section is severed between the sewn article portions and the article portions are finished to secure the severed ends of the single slide fastener tape section. A slider may be installed on the retainer half of the slide fastener stringer tape section at any time during the manufacture of the slide fastener stringer tape section or the attachment of the article portions prior to the finishing of the article portions.

8 Claims, 12 Drawing Figures

INSTALLATION OF SEPARABLE SLIDE FASTENER ON ARTICLE

TECHNICAL FIELD

The present invention relates to methods of forming an installation of a fully separating-type slide fastener in an article, such as between the left and right front portions of a jacket or the like.

DESCRIPTION OF THE PRIOR ART

In the manufacture of jackets or the like in the prior art, individual separating-type slide fasteners are installed in the respective jackets or jacket portions which are handled separately. Each slide fastener is installed by first serging an inner edge of one jacket portion to one of the tapes of the slide fastener and then serging an inner edge of the opposite jacket portion to the other tape of the slide fastener. The serged jacket portions are folded to form desired folded flaps over the slide fastener tapes and individual lines of straight stitches are made in each folded flap and slide fastener tape to secure each flap. Finishing steps at the top edge of each jacket secure the top ends of the slide fastener tapes to complete the installation. This prior arts process requires the selection and manipulation of individual slide fasteners and jacket panels in order to perform the installation.

The prior art, as exemplified in U.S. Pats. No. 2,697,227, No. 2,862,467, No. 3,780,682, and No. 3,081,462, discloses the manufacture of articles wherein article members are sewn to continuous lengths of tape, backing or lining material; the patent 2,697,227 particularly showing the sewing of fly strips to the tape of a continuous slide fastener stringer; and the patent 3,081,462 disclosing the sewing of a series of garments to a continuous stringer having transverse slits partially separating the stringer tape into sections which each have a stop members at opposite ends thereof, one stop member being a socket-stop member. U.S. Pat. No. 3,158,118 discloses the sewing of fastening elements to edges of fabric tapes. U.S. Pat. No. 2,638,650, No. 2,784,473 and No. 3,167,834 disclose slide fasteners formed from one continuous slide fastener stringer which has symmetrical coupling elements; the patents 2,638,650 and 2,784,473 disclosing separating pins and retainers at opposite ends of the single stringers; and the patent 2,638,650 suggesting the employment of a single stringer on a liner so that the liner may be used by itself as a single garment or the liner may be attached to a shell having a cooperating slide fastener stringer. The manufacture of slide fasteners and the formation of separating end connections thereof are illustrated in U.S. Pat. No. 2,996,797 as well as in the above mentioned U.S. Pat. No. 3,081,462.

SUMMARY OF THE INVENTION

The invention is summarized in a method of forming an installation of a separating-type slide fastener on a pair of opposite portions of an article, including the steps of sewing one of the pair of article portions to one half of a single slide fastener stringer tape section which has a retainer at one end and a pin member at the other end for mating with the retainer, sewing the other article portion to the other half of the single slide fastener stringer tape section with the other article portion oriented opposite to the one article portion, severing the single slide fastener stringer tape section between the sewn article portions, and finishing the article portions at the severed ends of the halves of the single slide fastener stringer tape section to secure the severed ends.

An object of the invention is to develop a procedure for installing a separating-type slide fastener in an article wherein the effort to produce the installation is reduced resulting in increased production.

It is also an object of the invention to eliminate some of the manipulation required in the prior art production of articles with fully separating slide fasteners.

One advantage of the invention is that single operations can be accomplished on a large number of interconnected garments.

One feature of the invention is that apparatus presently used to attach slide fasteners to articles can be employed in the method.

Other objects, advantages and features of the invention will be apparent from the following description of the preferred embodiments taken in conjunction with the accompanying drawings.

DESCRIPTION OF THE PREFERRED EMBODIMENT

Figure 1:
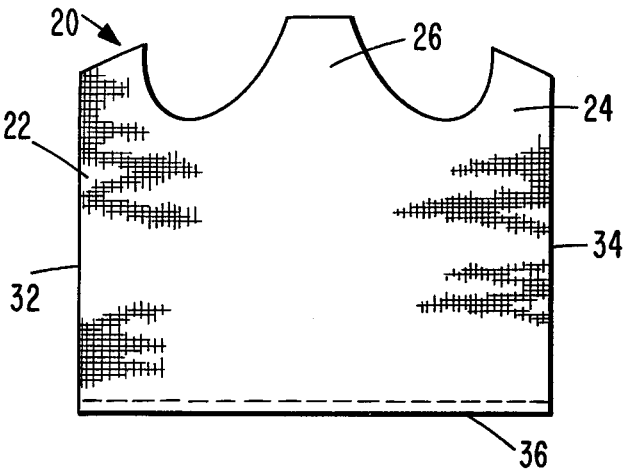
FIG. 1 is a plan view of a single panel for forming both the front and back of a jacket on which a fully separating slide fastener is to be installed in accordance with the invention.
Figure 2:
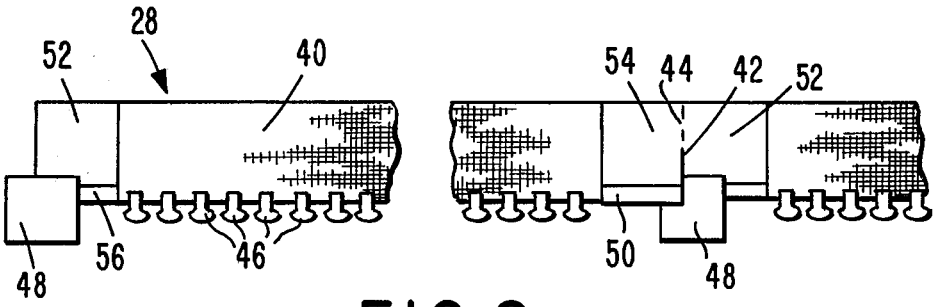
FIG. 2 is a plan view of a single slide fastener stringer, with portions broken away, employed in forming a fully separating slide fastener on the jacket panel of FIG. 1.

An article, such as a single jacket panel indicated generally at 20 in FIG. 1, has opposite portions, such as a left front portion 22 and a right front portion 24 separated by a back portion 26, wherein a section of a single slide fastener stringer, indicated generally at 28 in FIG. 2, is to be installed or attached to edges 32 and 34 of the respective portions 22 and 24 in accordance with the invention to form a fully separating slide fastener for an opening of the article. In one particular example, the jacket panel 20 is cut from fleece-lined material and is intended for construction of a jacket portion of a jogging or warm-up suit. The bottom edge 36 of the panel 20 has previously been hemmed. Although the present method is particularly illustrated for installation of a separating-type slide fastener on a jacket, such method is applicable to any other article requiring a fully separable slide fastener installed between opposite portions of the article.

The slide fastener stringer 28 includes a continuous length of tape 40 with transverse or perpendicular slits 42 extending from one longitudinal edge of the tape partially across the tape to divide the tape into sections which have a length a little longer, for example 5 to 8 centimeters (2 to 3 inches) longer, than the sum of the lengths of the edges 32 and 34 of the jacket portions 22 and 24. Perforated or weakened lines 44 may extend from the slits 42 across the tape 40 to the other edge thereof so that the sections of tape may be readily separated. Spaced fastening elements 46 are secured to the one edge of the tape from which the slits 42 extend. A retainer 48 is fastened to one end of each section of the tape 40 while a cooperating pin member 50 is attached or formed on the other end of each section of the tape 40 on the edge supporting the elements 46 and on the corner flaps formed by the slits 42. Reinforcements 52 and 54 are secured on one or both sides of the tape 40 at the respective opposite ends of each section of the single slide fastener stringer.

The fastening elements 46 are conventional fastening elements which are sufficiently symmetrical so that they will interlock with each other when the longitudinal orientation of one half of each tape section is reversed and mated with the other half. Examples of one type of suitable molded coupling elements are disclosed in U.S. Pats. No. 4,033,014 and No. 4,140,157. Also the conventional meander continuous filament construction, commonly referred to as the Ruhrmann-type ladder construction, can be employed. In addition, any other metal, molded plastic, helical coil, etc. fastening element which has sufficient symmetrical operation to interlock when the orientation of one-half of a single tape section is reversed can be used.

The retainers 48, the pin members 50 and, reinforcements 52 and 54 can be any conventional retainers, pin members and reinforcements. They may be integrally molded units of plastic, or members which are applied separately. The retainers 48 and pin members 50 may be metal with the retainers 48 secured on members 56 which are similar in construction to the pin members 50. The reinforcements 52 and 54 may be segments of a thermoplastic tape or film bonded to one or both sides of the tape 40. In one particular example, the pin member 50 as well as the supporting member 56 are formed by cutting off the head portions of molded plastic coupling elements 46 leaving the leg portions attached to the tape and then folding and bonding a segment of thermoplastic tape over the remaining leg portions and on the opposite sides of the tape to form the pin member 50, the supporting member 56 and the reinforcements 52 and 54; the slit 46 and perforated line 44 conveniently can be formed simultaneously with the folding and bonding and the retainers 48 being can be secured on the supporting members 56 in a later step.

Figure 3:
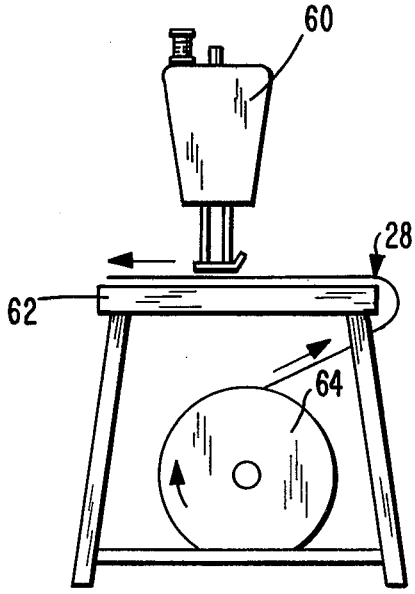
FIG. 3 is a side elevation view of a serging machine which may be employed in the present method.
Figure 4:
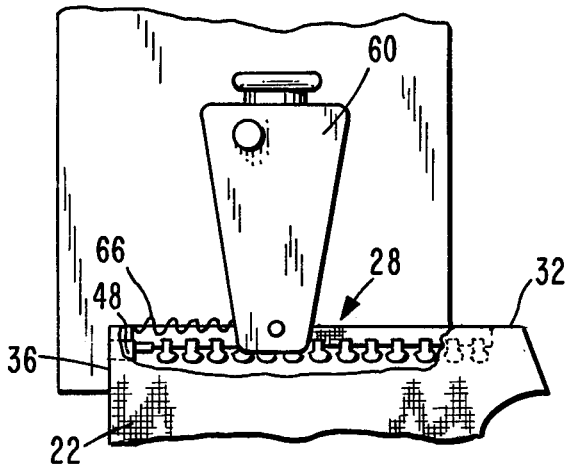
FIG. 4 is a plan view of the machine of FIG. 3 illustrating one step of the present method.

In a first procedure, a plurality of the jacket panels 20 are serged to the respective successive sections of the single continuous slide fastener stringer 28 by means of a conventional serge type sewing machine 60, shown in FIGS. 3 and 4, which is mounted on a table top 62 in a conventional manner. The continuous stringer 28 is fed from a reel 64 mounted under the table top 62 with the retainer end of the first section of slide fastener stringer 28 being the leading end of the stringer 28. The edge 32 of the jacket panel portion 22 is positioned over the tape stringer 28 with the edge 32 being aligned with the outer or upper edge of the tape 40 of the stringer 28 and with the edge 36 being aligned with the retainer end of the first section of the stringer 28; the desired outer surface of the jacket panel 20 faces the stringer 28. These aligned edges of the stringer 28 and the panel portion 22 are then sewn together by a serging or overedge line of stitches 66 beginning at the aligned retainer end of the stringer 28 and the bottom edge 36 of the panel portion 22. Since the stringer section is a little more than twice as long as the edge 32, the panel portion 22 is sewn to a first half of the slide fastener stringer section.

Figure 5:
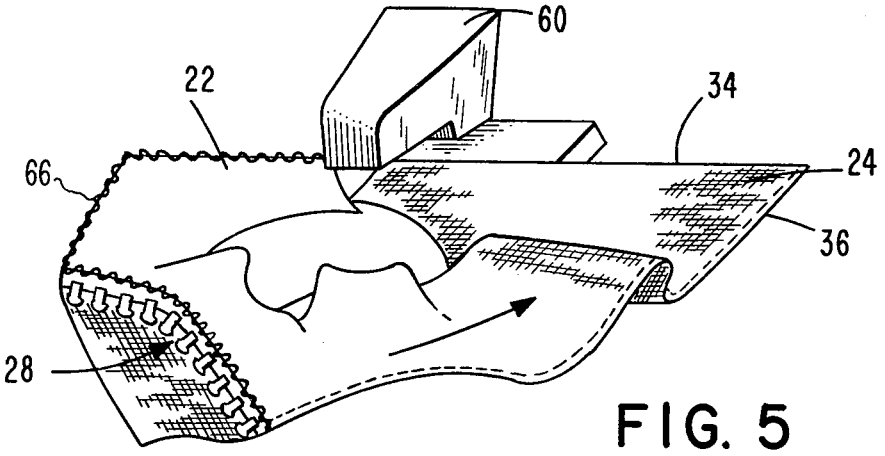
FIG. 5 is perspective view of the machine in FIGS. 3 and 4 illustrating a subsequent step in the present method.

After the jacket portion 22 has been sewn to the first half of the stringer section 28, the jacket portion 24 is positioned over the second half of the stringer section 28, as shown in FIG. 5, with the jacket portion 24 being oriented in the opposite direction to the jacket portion 22. The edge 34 is aligned with the outer or upper edge of the tape 40 of the stringer 28 in the same manner as performed with the jacket portion 22. The jacket portion 24 is positioned so that the pin end of the section of slide fastener stringer will be aligned with the bottom edge 36 of the jacket portion 24. Continued operation of the serge sewing machine 60 continues the line of overedge stitches 66 to sew the jacket portion 24 to the second half of the slide fastener stringer section.

Figure 6:
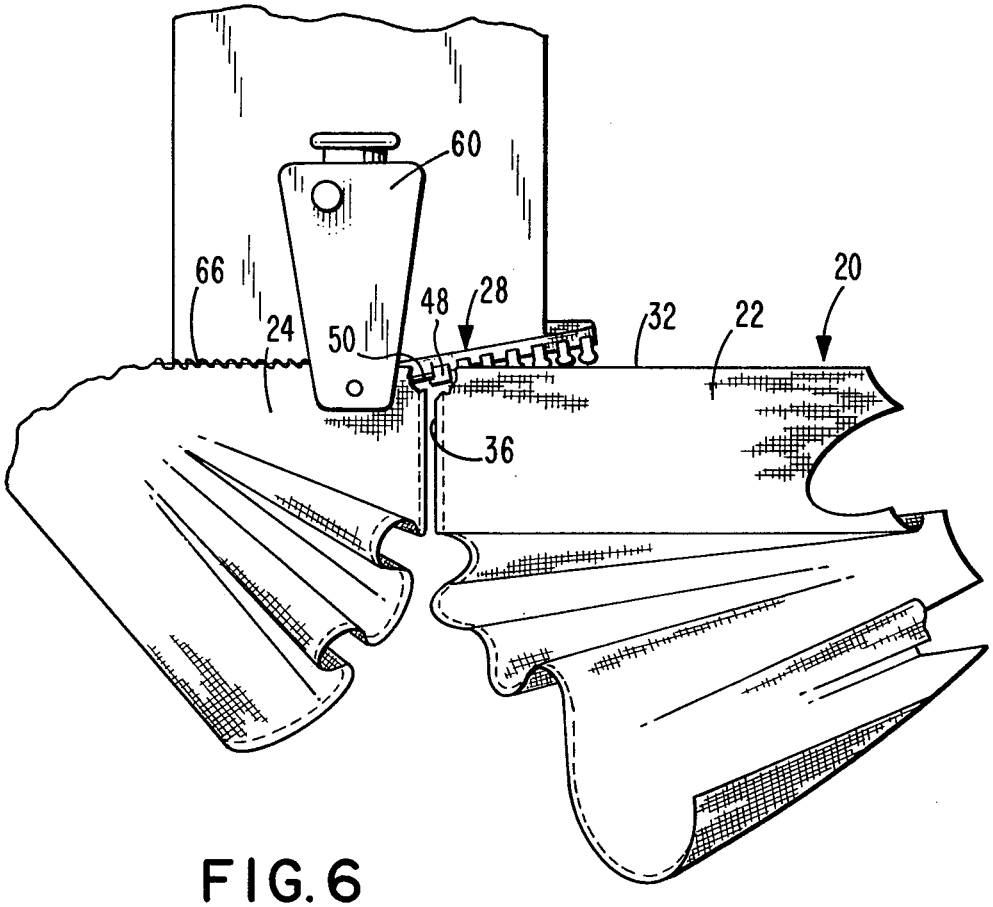
FIG. 6 is a plan view similar to FIG. 4 but illustrating a still further step in the described method.

As the serging of the jacket portion 24 to the second half of the section of slide fastener stringer nears completion, the jacket portion 22, FIG. 6, of another jacket panel 20 is moved into position over the slide fastener stringer 28 with the edge 36 of the portion 22 aligned with the retainer end of the next section of the stringer and with the edge 32 of the jacket portion 22 aligned with the outer or upper tape edge of the stringer 28. The serging of the second jacket panel to the slide fastener stringer 28 by continuing the line of overedge stitches 66 proceeds in the same manner as described in connecting the first jacket panel shown in FIGS. 4 and 5. Additional jacket panels are serged to succeeding sections of the slide fastener stringer 28 in an identical manner until the desired number of jacket panels have been serged or the end of the slide fastener stringer is reached. As the serging of the jacket panels to the continuous slide fastener stringer 28 proceeds, the jacket panels already serged are directed into a suitable holding container (not shown).

Figure 7:
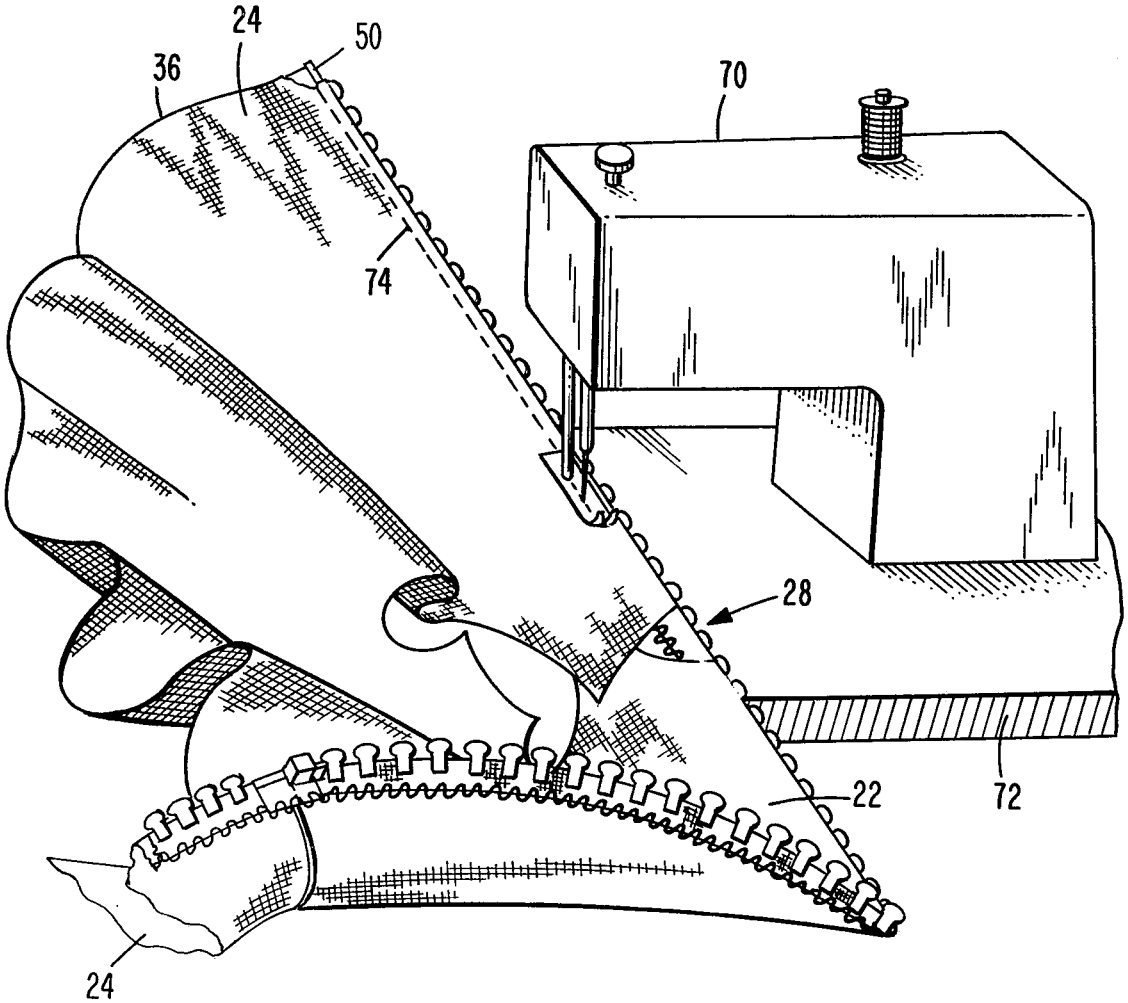
FIG. 7 is a perspective view of a straight stitch sewing machine performing a still later step in the installation of a separating slide fastener on a jacket.

After the serging of the jacket panels has been completed, the jacket panels are withdrawn from the container in the reverse order and topstitched as shown in FIG. 7 by a conventional straight line or topstitching sewing machine 70 mounted on a table 72. The jacket panels 24 and 22 are folded back and sewn by the sewing machine 70 with a straight line of stitches 74 beginning at the aligned pin end of the last slide fastener stringer section and edge 36 of the last jacket portion 24 which passed through the serging operation. The folding of the garment portions 24 and 22 is made in a manner to produce a desired amount of folded flap for covering, or leaving exposed, the fastening elements in the completed jackets. The folding of the jacket portions and the sewing of the line of stitching 74 proceeds from the jacket portion 24 to the jacket portion 22 and then to the jacket portion 24 of the next jacket panel, and so on, until the entire string of jacket panels interconnected by the slide fastener stringer 28 has been topstitched.

Figure 8:
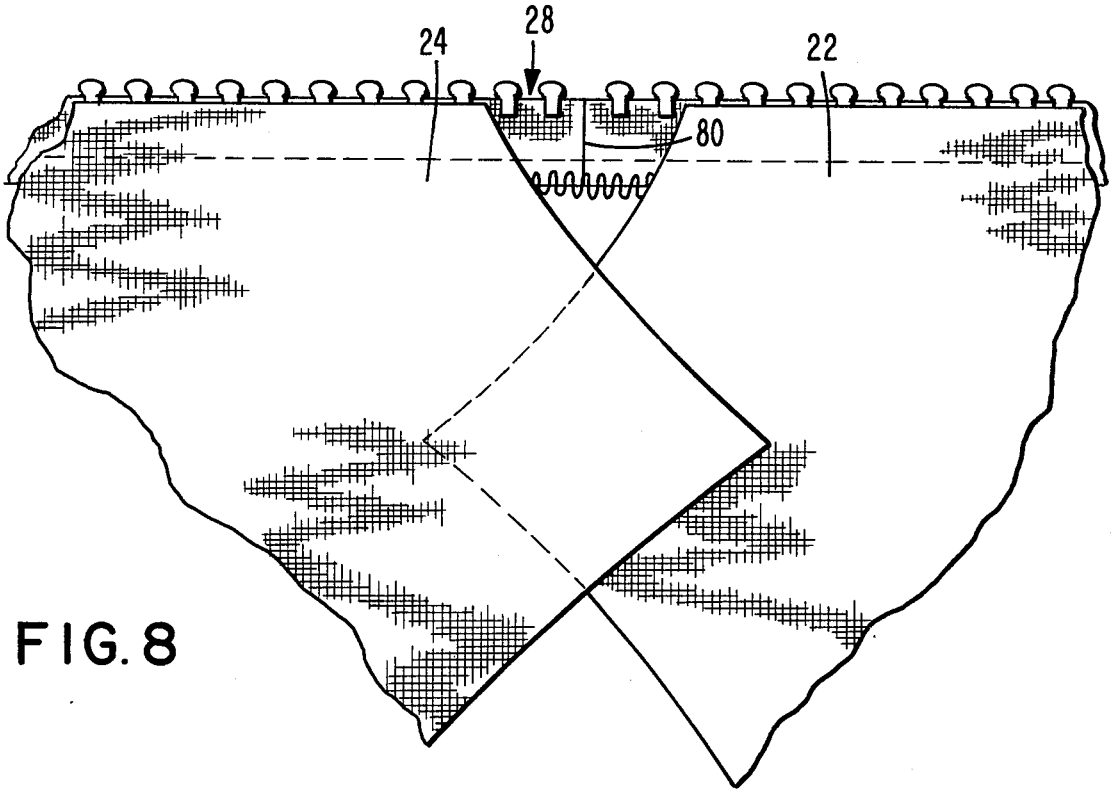
FIG. 8 is a plan view of a broken away portion of joined left and right front jacket portions illustrating a separating or severing step for the continuous slide fastener stringer.
Figure 9:
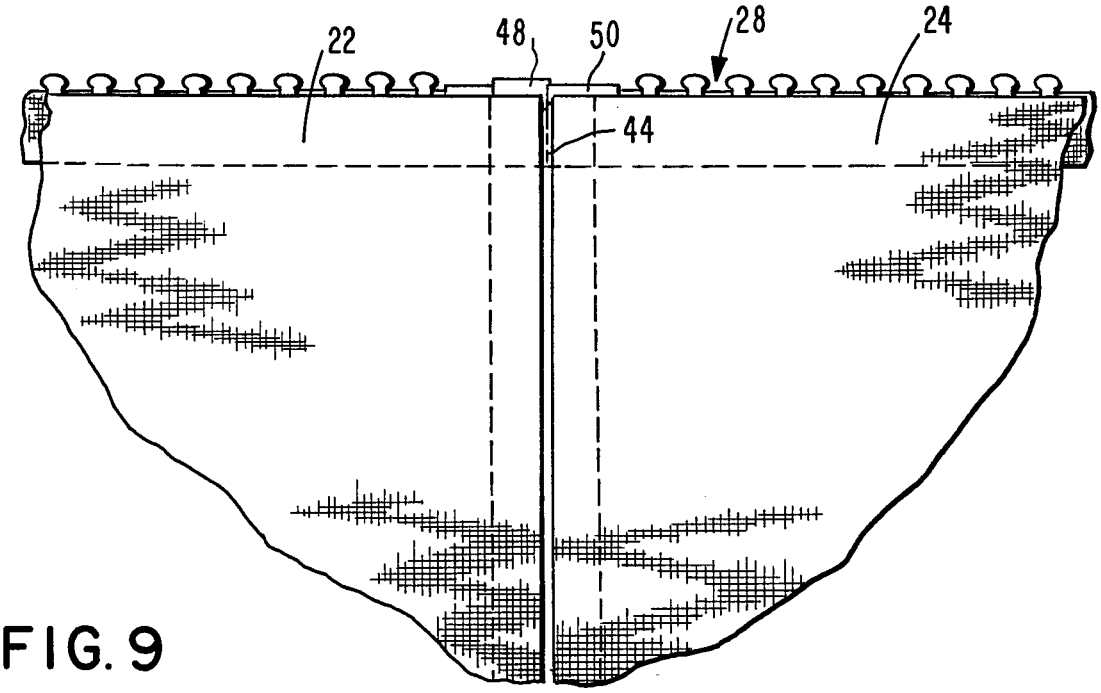
FIG. 9 is a plan view of broken away portions of two adjacent jacket panels illustrating a separating step for separating the jacket panels from each other.

After topstitching, the jacket portions 22 and 24 are separated by severing the slide fastener stringer 28 along a line 80, illustrated in FIG. 8, intermediate the jacket portions 22 and 24. Also the jacket panels 20 are separated from each other by severing or snapping apart the slide fastener stringer 28 along the perforated or score line 44 between adjacent sections of the slide fastener stringer as shown in FIG. 9. The threads forming the continuous over-edge stitching 66 and continuous straightline of stitching 74 are also severed simultaneously with the separation of the jacket panels 22 and 24 along line 80 and with the separation of separate jacket panels along the perforated line 44.

The installation of a separating slide fastener on the jacket panel is then completed by threading a slider onto the severed end of the stringer section half containing the retainer, and by sewing the free or severed ends of the slide fastener section halves into the garment during further finishing operations on the garment; for example, the severed ends can be buried in the collar or neckline during the sewing thereof. The finishing of the jacket is performed in a conventional manner. It is noted that the slider for the slide fastener may be placed on the stringer half with the retainer at any time during the manufacture of the slide fastener stringer or its attachment to the jacket portions prior to the finishing of the top portion of the jacket at the severed ends of the slide fastener stringer halves.

Figure 10:
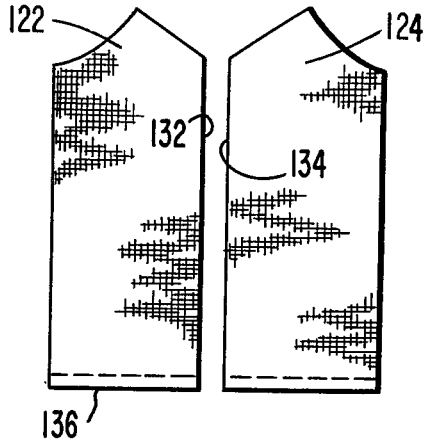
FIG. 10 is a plan view of separate left and right front panels for an alternate construction of a jacket employing such separate panels.
Figure 11:
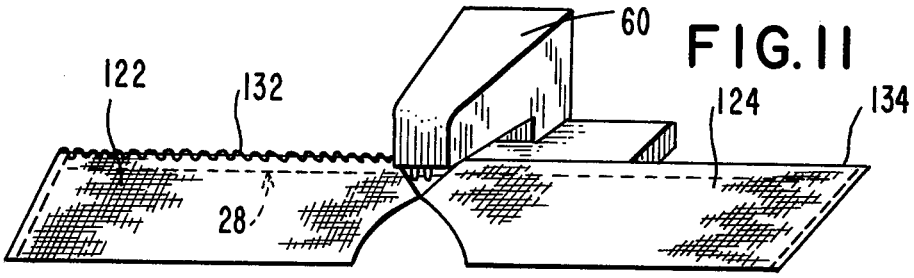
FIG. 11 is a perspective view similar to FIG. 5 but illustrating one step of the present method in installing a separable slide fastener on the jacket panels of FIG. 10 instead of the single piece jacket panel of FIG. 1.
Figure 12:
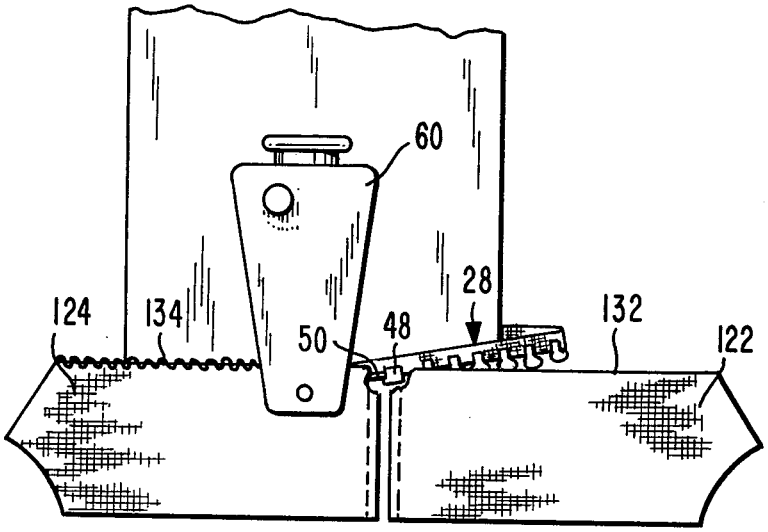
FIG. 12 is a view similar to FIG. 6 but illustrating a similar step employing the separate jacket panels of FIG. 10 in place of the single piece jacket panel of FIG. 1.

In FIG. 10, there are illustrated separate from left jacket panel 122 and right front jacket panel 124. As illustrated in FIG. 11, the panels 122 and 124 are serged to the slide fastener stringer 28 in a manner substantially similar to the serging of the jacket panels 22 and 24 illustrated in FIGS. 4 and 5. Also, a plurality of pairs of the jacket panels 122 and 124 are serged on succeeding sections of the slide fastener stringer, as illustrated in FIG. 12, in a similar manner to the serging of a plurality of pairs of the panels 22 and 24 on succeeding slide fastener stringer sections illustrated in FIG. 6. The steps of topstitching and separating the jacket portions from each other by severing or snapping apart the slide fastener stringer and continuous lines of stitching proceed in a manner similar to that described above in connection with the single jacket panels 20. Also the slider may be installed at any time on the slide fastener stringers adjacent the retainer, and the severed ends of the slide fastener section halves are sewn into the jacket during the finishing steps for the jacket.

The present invention, by utilizing a single slide fastener stringer for forming the installation of fully separating type slide fasteners on articles, substantially reduces manipulations and handling procedures compared to prior art manufacturing methods. A single continuous stitching operation is performed in the serging, and a second single stitching operation is performed in the topstitching to attach a plurality of pairs of garment portions to the slide fastener stringer. The separate manipulation of slide fastener tapes and garment portions is reduced by sewing the plurality of article portions to the continuous slide fastener stringer to connect the article portions in an continuous train. Handling of separate article portions and slide fasteners is eliminated in the topstitching step. Since the present process uses conventional equipment already used for the installation of slide fasteners in articles, an article manufacturer can easily employ the present process without requiring further advanced technological equipment and with a minimum amount of sewing machine operator training.

Since the above-described embodiments are subject to many variations, modifications and changes in detail, it is intended that all matter in the foregoing description and shown in the accompanying drawings be interpreted as illustrative and not in a limiting sense.

What is claimed is:

1. A method of forming an installation of a separating type slide fastener to a pair of opposite portions of an article, comprising the steps of sewing one of the pair of article portions to one half of a single slide fastener stringer tape section which has a retainer at one end and a pin member at the other end for mating with a retainer, sewing the other article portion to the other half of the single slide fastener stringer tape section with the other article portion oriented opposite to the one article portion, severing the single slide fastener stringer tape section between the sewn article portions, and finishing the article portions at the severed ends of the halves of the single slide fastener stringer tape section to secure the severed ends.

2. A method as claimed in claim 1 wherein both of said sewing steps are performed by a sewing procedure including the forming of a single line of stitching extending along the entire length of the single slide fastener stringer tape section through the successive pair of article portions.

3. A method as claimed in claim 2 wherein said sewing procedure includes the serging of one edge of the slide fastener stringer tape section to corresponding edges of the pair of article portions.

4. A method as claimed in claim 3 wherein said sewing procedure also includes the steps of folding the pair of article portions adjacent to the serging stitches and forming a line of straight stitching through the folded article portions and the slide fastener stringer tape section.

5. A method of forming attachments of separating slide fasteners on respective pairs of opposite portions of articles, comprising the steps of sequentially sewing the pairs of opposite article portions to successive sections of a single slide fasten stringer tape wherein each stringer tape section has a retainer at one end and a pin member at the other end, said sewing the pairs of opposite article portions including the sequential sewing of one article portion of each pair of opposite article portions to one half of the respective stringer tape sections and then sewing the other article portion of each pair of article portions to the other half of the respective stringer tape section with the article portions of each pair being oriented opposite to each other, severing the single slide fastener tape between each pair of sewn article portions, separating the slide fastener tape between the retainers and pin members of adjacent sections, and finishing the article portions at the severed ends of the halves of the single fastener stringer tape sections to secure the severed ends.

6. A method as claimed in claim 5 wherein said sewing the pairs of opposite article portions is performed by a sewing procedure which includes the forming of a continuous line of stitches along the single slide fastener stringer tape and the pairs of opposite portions of articles.

7. A method as claimed in claim 6 wherein said forming of a continuous line of stitches in the sewing procedure forms is a continuous line of serging stitches joining edges of the article portions to an edge of the slide fastener stringer tape.

8. A method as claimed in claim 7 wherein said sewing procedure also includes the folding of the article portions, and the forming of a continuous line of straight stitches through the folded article portions and the single slide fastener stringer tape.

* * * * *